United States Patent [19]

Arita et al.

[11] 4,439,247

[45] Mar. 27, 1984

[54] METHOD FOR MANUFACTURE OF HIGH-STRENGTH HIGH-ELECTROCONDUCTIVITY COPPER ALLOY

[75] Inventors: Kishio Arita; Toshio Takahashi, both of Musashino; Akio Miyoshi; Hajime Izumimori, both of Ichikawa; Mitsushi Ishida, Tokyo, all of Japan

[73] Assignees: Sumitomo Metal Mining Company Limited; Nippon Telegraph and Telephone Public Corporation; Nippon Telecommunication Engineering Company Limited, all of Tokyo, Japan

[21] Appl. No.: 443,556

[22] Filed: Nov. 22, 1982

[30] Foreign Application Priority Data

Nov. 30, 1981 [JP] Japan ..... 56-193392

[51] Int. Cl.[3] ..... C22F 1/08

[52] U.S. Cl. ..... 148/2; 148/11.5 C; 148/12.7 C

[58] Field of Search ..... 148/11.5 C, 12.7 C, 148/412, 433, 160, 2; 420/470, 472, 495

[56] References Cited

U.S. PATENT DOCUMENTS

| | | | |
|---|---|---|---|
| 1,723,867 | 8/1929 | Korsunsky | 148/11.5 C |
| 4,047,980 | 9/1977 | Watson et al. | 148/11.5 C |

FOREIGN PATENT DOCUMENTS

| | | | |
|---|---|---|---|
| 577850 | 6/1959 | Canada | 420/495 |
| 52-123923 | 10/1977 | Japan . | |
| 55-11145 | 1/1980 | Japan | 420/495 |

*Primary Examiner*—Peter K. Skiff

*Attorney, Agent, or Firm*—Watson, Cole, Grindle & Watson

[57] ABSTRACT

A copper alloy which is high in strength and electroconductivity is manufactured by casting, without chill casting, a copper alloy mass substantially consisting of copper and containing 0.2 to 1.5% by weight of chromium and 0.01 to 0.5% by weight of tin, hot working the cast copper alloy mass, then cooling, not slowly, the hot worked alloy mass without being subjected to any solid solution treatment, further cold working the cooled alloy mass, and thereafter subjecting the cold worked alloy mass to an aging treatment.

6 Claims, 1 Drawing Figure

METHOD FOR MANUFACTURE OF HIGH-STRENGTH HIGH-ELECTROCONDUCTIVITY COPPER ALLOY

BACKGROUND OF THE INVENTION

1. Field of the Invention

This invention relates to a method for the manufacture of a copper alloys containing chromium and tin, which are advantageously useful as a lead frame material for integrated circuits (IC's).

2. Description of Prior Art

In recent years, growing integration of semiconductor circuits, emergence of IC's which are high in current capacity, and the widespread trend toward minimization in of lead frames, in due respect to preservation of natural resources have all gone to presenting ever exacting demands on the quality of copper alloys used as the material for the lead frames e.g., in terms of strength, workability, electroconductivity, and heat resistance. To be specific, a material is rated as optimum when it wholly satisfies the requirements that its tensile strength exceeds 50 kg/mm$^2$, that elongation at breaking should exceed 7%, that electroconductivity exceeds 80% I.A.C.S., and so on.

Heretofore, CDA (Copper Development Association in the U.S.A.) alloy 194, phosphor bronze, tin-containing heat-resistant copper, copper-chromium alloys, copper-chromium-tin alloys, etc., have been available as alloy materials for lead frames. Of these alloy materials, however, CDA alloy 194, phosphor bronze, and tin-containing heat-resistant copper do not wholly satisfy the requirements mentioned above.

CDA alloy 194 displays 45 kg/mm$^2$ of tensile strength, 4% of elongation at breaking, and 65% I.A.C.S. of electroconductivity, and thus fails to satisfy the three noted characteristics. Phosphor bronze displays 55 kg/mm$^2$, 8%, and 15% I.A.C.S., respectively, of the aforementioned properties, thus exhibiting insufficient electronconductivity while satisfying the characteristics of strength and elongation. Tin-containing heat-resistant copper displays 38 kg/mm$^2$, 4%, and 84% I.A.C.S. respectively of the aforementioned properties, thus exhibiting satisfactory electroconductivity but failing to satisfy the other characteristics of strength and elongation.

It has been heretofore disclosed in Japanese Patent Laid Open Publication No. 123923/1977 that a copper-chromium alloy containing not more than about 5% by weight of chromium and an improved type thereof, i.e., copper-chromium-tin alloy containing not more than 1% by weight of chromium and between 0.30 and 0.95% by weight of which are produced by adding chromium, the element capable of forming a solid solution with copper at elevated temperatures and practically incapable of forming such a solid solution at low temperatures, subjecting the alloys to a solid solution treatment at elevated temperatures and then quenching the solid solution, thereby allowing the added elements to precipitate on aging in the copper matrixes, satisfy all the aforementioned requirements. But to obtain a copper-chromium alloy or a copper-chromium-tin alloy which satisfies these characteristics it was necessary that the cast alloy mass mentioned above should be subjected, either directly or after a hot working step, to a solid solution treatment generally at amply high temperatures of about 1000° C., then quenching the resultant alloy mass, and further subjecting the quenched alloy mass to an age-hardening treatment. When the solid solution treatment is carried out in air, it entails vigorous oxidation of the interior as well as the surface of the alloy mass. This treatment, therefore, must be carried out under an atmosphere of a non-oxidizing gas and, consequently, suffers from increased production costs. Furthermore, when the large alloy mass is subjected to the solid solution treatment, it becomes extremely difficult to produce a homogeneous alloy satisfying all the characteristics mentioned above because the quenching treatment to be given subsequently to the solid solution treatment is not capable of conferring an ample quenched effect uniformly upon the entire mass.

To cope with this situation, the present inventors perfected an invention titled "Conductive Alloy for Integrated Circuits and Method for Manufacture Thereof" see (Japanese Patent Laid Open Publication No. 65956/1981) to provide improvements in and concerning the aforementioned method for manufacture of copper-chromium alloy and copper-chromium-tin alloy. Specifically, this method produces an eutectic dispersion-strengthened alloy solely by the steps of melting a copper-chromium alloy with addition of other elements such as tin, chill-cast material of a structure having a uniformly dispersed phase of fine chromium particles, and subjecting the cast material, without being intervened by any solid solution treatment and aging treatment, to cold working and annealing. But when a cast alloy mass of a large volume is to be produced by this chill casting method, it encounters a difficulty in the industry to attain a cooling speed enough to impart uniformly to the cast alloy mass the aforementioned dispersed eutectic structure. For the production of a material which must be available as an inexpensive mass-producible article such as a lead frame, this method has not found acceptance.

After all, the copper-chromium alloy and copper-chromium-tin alloy inevitably suffer from a high production cost and barely find utility in small-scale manufacture of the nature of trial production or experimental production because the aforementioned known method of manufacture brings about an increase in cost and the material is subject to a rigid restriction that it should be amply small in size.

SUMMARY OF THE INVENTION

In view of the state of affairs described above, the inventors of this invention conducted a research with emphasis particularly on the aforementioned known copper-chromium alloy in the hope of developing a material satisfying all the characteristics which are required for an IC's lead frame material. They consequently acquired the following knowledge. In the research, an alloy produced by adding tin in a varying proportion in the range of 0 to 0.5% by weight to an ordinary copper-chromium alloy (having a chromium content of 0.83 to 0.87% by weight), was molten and cast in the air as usually practiced in the art to obtain a cast mass having a cross section of the square of 60 mm. The cast mass was hot rolled to a thickness of 4 mm, subjected to a solid solution treatment at temperatures of 900° to 1000° C., and thereafter cooled with water. The cooled alloy plate was pickled, cold rolled to a thickness of 0.313 mm, and thereafter subjected to an aging treatment at 450° C. for one hour. A sample of the resultant sheet was tested for Vickers hardness. The results of the test are shown in Table 1 in conjunction with the composition of the sample. The results are graphically represented in FIG. 1.

TABLE 1

| Alloy No. | Composition (% by weight) Cr | Sn | Cu | Vickers hardness (500 g) Temperature of solid solution treatment (°C.) 900 | 950 | 1000 |
|---|---|---|---|---|---|---|
| 1 | 0.85 | <0.001 | Balance | 120 | 128 | 149 |
| 2 | 0.85 | 0.01 | Balance | 134 | 142 | 156 |
| 3 | 0.87 | 0.07 | Balance | 146 | 160 | 166 |
| 4 | 0.86 | 0.16 | Balance | 152 | 163 | 170 |
| 5 | 0.83 | 0.48 | Balance | 160 | 164 | 171 |

From the results shown above, it is noted that the addition of tin was brought about notable improvement in the age-hardening of the material and that this age-hardening was not appreciably affected by the temperature of the solid solution treatment. In other words, the results indicate that even when the temperature of the solid solution treatment was at about 900° C., the level equal to the temperature at which the hot rolling was carried out, the hardness which the material acquired in consequence of age-hardening was similar to that obtained by performing the solid solution treatment at a higher temperature.

In addition to the knowledge described above, the following knowledge was also obtained. Of the cast masses having a cross section of the square of 60 mm molten and cast in the research described above, those of Alloy Nos. 1, 3, and 4 were hot rolled to a thickness of 4 mm similarly to the aforementioned procedure and subjected to a solid solution treatment at 950° C. The hot rolled plates thus obtained were placed in an electric furnace capable of cooling such rolled plates at any controlled speed and quenched therein at three different cooling speeds indicated in Table 2. The quenched alloy plates were pickled, cold rolled to a thickness of 0.34 mm, and thereafter subjected to an aging treatment at 450° C. for one hour by following the aforementioned procedure. Samples of the resultant alloy sheets were tested for Vickers hardness. The results are shown in Table 2.

TABLE 2

| Alloy No. | Vickers hardness (500 g) Cooling speed (°C./sec.) 80 | 3 | 0.3 |
|---|---|---|---|
| 1 | 130 | 108 | 107 |
| 3 | 162 | 161 | 157 |
| 4 | 165 | 164 | 159 |

From the results given above, it can be seen that the addition of tin serves to sufficently proceed the age-hardening of the material even at a cooling speed of about 0.3° C./min. which is slower than the ordinary spontaneous cooling in the air, though it is somewhat lesser than the age-hardening effected at the cooling speed of about 80° C./min, i.e., the speed similar to the ordinary cooling with water. In other words, the results indicate that the procedure described above produced a material having high hardenability enough for the quenching to be effectively attained even at such a low cooling speed as describe above.

DETAILED DESCRIPTION OF THE INVENTION

Figure 1:
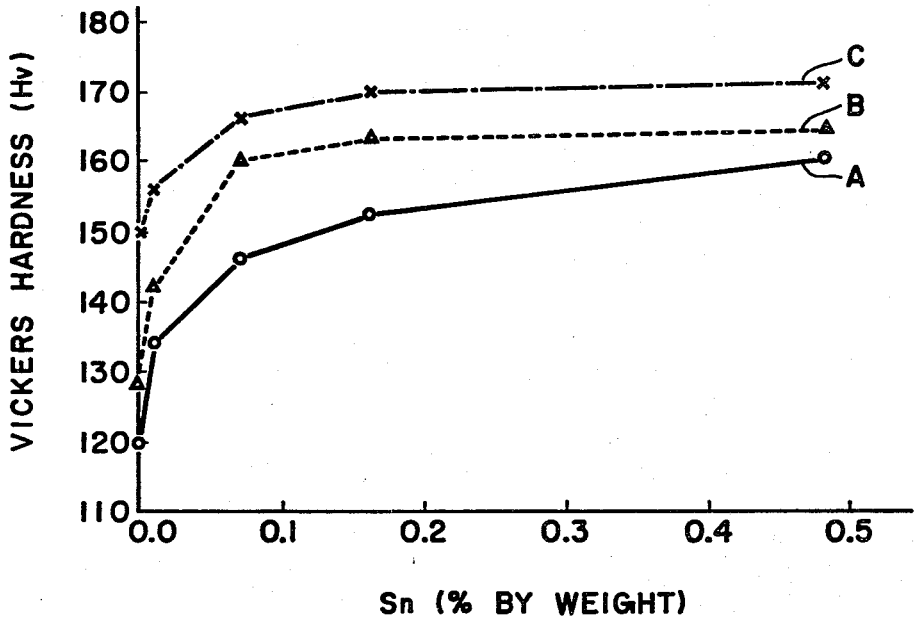
FIG. 1 is a graph showing the results of Table 1, namely the relation between the tin content in % by weight and the Vickers hardness. In the graph A, B, and C denote the curves obtained of the solid solution treatments performed at the temperatures of 900°, 950°, and 1000° C., respectively.

This invention has been completed on the basis of the knowledge described above. To be specific, this invention provides a method which permits a copper-chromium type copper-based alloy possessing not less than 50 kg/mm$^2$ of tensile strength, not less than 7% of elongation at breaking, and not less than 80% I.A.C.S. of electronconductivity and excelling in heat resistance to be mass-produced inexpensively on a industrial scale. The copper alloy of the present invention is manufactured by casting, by any known method without chill casting, a copper alloy mass substantially consisting of copper besides containing 0.2 to 1.5% by weight of chromium and 0.01 to 0.5% by weight of tin, hot working the resultant copper alloy mass at an ordinary temperature, then cooling, at a speed of air cooling or a higher speed, namely, not slowly, the resultant hot worked alloy mass without being subjected to a solid solution treatment which has been heretofore found or thought necessary, further cold working the cooled alloy mass, and thereafter subjecting the resultant cold worked alloy mass to an aging treatment.

Now, the operation and effect of each of the component elements of the alloy to be obtained by the method of manufacture contemplated by the present invention and the reason for the limitation of the concentration of such component element in the alloy will be described below.

When the chromium content is less than 0.2% by weight, the improvement in strength of the produced alloy cannot be expected. When it exceeds 1.5% by weight, comparatively coarse primary crystals of chromium are distributed in the matrix of the alloy and, therefore, render desired uniform dispersion of fine chromium particles in the copper matrix difficult. Hence, the chromium content is fixed in the range of 0.2 to 1.5% by weight. When the tin content is less than 0.01% by weight, chromium is not thoroughly solutionized into the copper matrix of the hot worked material and the material does not thoroughly age-harden after the cold rolling. When it exceeds 0.5% by weight, the material gains in strength after the aging treatment bum reduces the electroconductively. The excess is only wasted. The tin content, therefore, is fixed the range of 0.01 to 0.5% by weight.

Although the alloy of the present invention essentially consists of the three elements, copper, chromium, and tin, as described above, it may have a tolerance for the presence of phosphorus for deoxidation or inevitable invasion of the impurity.

Now, the method of the present invention will be described below. The hot working of a cast copper alloy mass of the aforementioned composition is started at a temperature of 800° C. or over, more desirably at a temperature in the range of 850° to 950° C. Since chromium and tin thoroughly are solutionized into the copper matrix of the aforementioned alloy material during the step of heating which precedes the step of hot working and also during the step of hot working, the step of solid solution treatment is simultaneously carried out during the step of hot working.

The cooling of the alloy material after the step of hot working may be performed with water. When this cooling is also made in the air as generally practiced during the working of any other alloy, precipitation of the component elements of the solid solution does not ensure. The cooling, therefore, is not required to be performed at a speed particularly higher than the speed of the water cooling which has been heretofore found indispensable to the known solid solution treatment or chill casting treatment. And by the subsequent aging treatment, chromium can be precipitated in a finely dispersed form in the copper matrix. In consequence of this precipitation of chromium, there is obtained a copper alloy which possesses the characteristics aimed at by the present invention. The aging treatment may be performed under the known conditions such as between 350° and 550° C. of temperature and up to four hours of duration. The aging treatment is not always required to be completed within one unbroken duration. When this treatment is performed in a plurality of durations interspersed with suitable steps of cold working such as finish rolling, it also imparts the desired characteristics to the produced alloy.

Now the method for the manufacture of copper alloy of the present invention will be described below with reference to working examples.

EXAMPLE 1

Ordinary pieces of electrolytic copper were molten in a high-frequency open melting furnace. The molten copper was admixed with varying amounts of chromium and tin calculated to give desired results, respectively in the form of a mother alloy of copper and chromium (having a chromium content of 10% by weight) and a granular metallic tin. The resultant molten alloy was cast in a mold by the ordinary casting method to provided a cast alloy mass. The mold used here was of a metal having a cross section of the square of 60 mm. The alloys involved here had compositions as shown in Table 3. Each cast mass was cut into two halves, which were heated to 900° C. and hot rolled to a thickness of 4 mm. One of the hot rolled plates was allowed to cool off spontaneously and the other cooled with water. The cooled plates were pickled and thereafter cold rolled to a thickness of 0.313 mm. The cold rolled sheets were subjected to an aging treatment at 450° C. for one hour and then tested for Vickers hardness. The results were as shown in Table 3.

TABLE 3

| Kind | Alloy No. | Composition (% by weight) Cr | Sn | Cu | Vickers hardness (500 g) Spontaneous cooling after hot rolling | Water cooling after hot rolling |
|---|---|---|---|---|---|---|
| Alloy for comparison | 6 | 0.70 | <0.001 | Balance | 94 | 115 |
| | 7 | 1.03 | <0.001 | Balance | 108 | 122 |
| Alloy of this invention | 8 | 0.85 | 0.01 | Balance | 139 | 142 |
| | 9 | 0.20 | 0.09 | Balance | 139 | 137 |
| | 10 | 0.79 | 0.11 | Balance | 140 | 140 |
| | 11 | 0.97 | 0.16 | Balance | 147 | 150 |
| | 12 | 0.66 | 0.48 | Balance | 160 | 159 |
| | 13 | 0.30 | 0.15 | Balance | 144 | 142 |
| | 14 | 0.83 | 0.15 | Balance | 147 | 150 |
| | 15 | 1.33 | 0.15 | Balance | 147 | 151 |
| | 16 | 1.45 | 0.15 | Balance | 150 | 153 |

It is noted from the table given above that when the copper alloy containing 0.2 to 1.5% by weight of chromium was added thereto tin in a proportion of 0.01 to 0.5% by weight, it had hardness notably improved as compared with the copper alloy with addition of tin in a proportion of less than 0.01% by weight. The alloys of the present invention showed virtually no discernible difference in hardness due to variation in the speed of cooling after the hot rolling. These results indicate that the incorporation of tin brought about similar improvement in the tensile strength which is in proportion to the hardness.

EXAMPLE 2

Cast alloy masses were obtained by following the procedure of Example 1, except that the copper alloy was molten in a low-frequency open melting furnace and the molten alloy was deoxidized with a mother alloy of copper and phosphorus (having a phosphorus content of 30% by weight) and cast by the ordinary method in a metal mold measuring 375 mm×150 mm×1200 mm. The compositions of the alloys involved herein were as shown in Table 4.

TABLE 4

| Kind | Alloy No. | Composition (% by weight) Cr | Sn | Cu |
|---|---|---|---|---|
| Alloy for comparison | 17 | 0.06 | <0.001 | Balance |
| | 18 | 1.00 | <0.001 | Balance |
| Alloy of this invention | 19 | 0.61 | 0.11 | Balance |
| | 20 | 0.89 | 0.11 | Balance |
| | 21 | 1.30 | 0.11 | Balance |

Each alloy mass was heated to 900° C., hot rolled to a thickness of 14 mm, and cooled with water at 670° C. After thinly planing the surface, the cooled plate was cold rolled to a thickness of 0.3 mm. The rolled sheet was subjected to a primary aging treatment at 400° C. for one hour and then cold rolled to a thickness of 0.25 mm.

The resultant rolled sheet and the sheet obtained by annealing at 450° C. for one hour were tested for tensile strength, elongation at breaking, and electroconductivity. The results were as shown in Table 5.

TABLE 5

| Kind | Alloy No. | Characteristics after primary aging and cold rolling: Tensile strength (kg/mm²) | Elongation at breaking (%) | Electro-conductivity (% I.A.C.S.) | Characteristics after annealing at 450° C.: Tensile strength (kg/mm²) | Elongation at breaking (%) | Electro-conductivity (% I.A.C.S.) |
|---|---|---|---|---|---|---|---|
| Alloy for comparison | 17 | 46.7 | 6.2 | 79 | 37.7 | 18.2 | 86 |
| | 18 | 48.1 | 5.9 | 78 | 38.2 | 17.5 | 86 |
| Alloy of this invention | 19 | 58.0 | 2.1 | 76 | 50.3 | 12.4 | 85 |
| | 20 | 58.4 | 2.9 | 76 | 51.0 | 13.8 | 84 |
| | 21 | 59.3 | 3.2 | 74 | 51.2 | 14.4 | 81 |

It is noted from Table 5 that the sheets annealed at 450° C. by the method of this invention invariably exhibited more than 50 kg/mm² of tensile strength, more than 12% of elongation at breaking, and more than 81% of electroconductivity, thus satisfying the respective requirements of the characteristics. Comparison of the tensile strength exhibited after the primary aging and cold rolling and after the annealing at 450° C. reveals that the alloys of the present invention excelled also in heat resistance.

As is evident from the foregoing description, the present invention offers a method of very high economic value which inexpensively produces from raw materials of large dimensions a copper-chromium-tin alloy abounding in strength and electroconductivity and excelling in workability and heat resistance.

What is claimed is:

1. A method for manufacturing a copper alloy which displays a tensile strength of 50 kg/mm² or more and an electroconductivity of 80% I.A.C.S. or more and is useful in fabricating lead frames for integrated circuits, said method avoiding any solid solution treatment steps and comprising (a) providing a copper alloy mass which consists essentially of 0.2 to 1.5% by weight chromium, 0.01 to 0.5% by weight tin, the balance being copper, (b) casting said copper alloy mass of step (a) without quenching, (c) hot working the cast copper alloy mass of step (b) at a temperature of between 800° to 950° C., (d) cooling said hot worked, cast copper alloy mass of step (c), (e) cold working said cooled, cast copper alloy mass of step (d), and (f) aging the cold worked, cast copper alloy mass of step (e).

2. The method as defined in claim 1 wherein said cooling in step (d) occurs at between 0.3° and 80° C./second.

3. The method as defined in claim 1 wherein in cooling step (d) the hot worked, cast copper alloy mass is contacted with water.

4. The method as defined in claim 1 wherein in cooling step (d) the hot worked, cast copper alloy mass is contacted with air.

5. The method as defined in claim 1 wherein in aging step (f) the cold worked, cast copper alloy mass is subjected to a temperature of from 350° to 550° C. for up to four hours.

6. The method as defined in claim 1 wherein the copper alloy mass provided in step (a) includes some phosphorus for deoxidation.

* * * * *